US005671997A

United States Patent [19]

Potts

[11] Patent Number: 5,671,997

[45] Date of Patent: Sep. 30, 1997

[54] TAMPER-RESISTANT FIXTURE FOR SELF-LUMINOUS RADIOACTIVE LIGHT

[76] Inventor: J. Barry Potts, 5876 Willow Street, Vancouver, British Columbia, Canada, V5Z 3S6

[21] Appl. No.: 353,528

[22] Filed: Dec. 8, 1994

Related U.S. Application Data

[63] Continuation-in-part of Ser. No. 69,378, Jun. 1, 1993, abandoned.

[51] Int. Cl.[6] ..... G09F 13/00

[52] U.S. Cl. ..... 362/84; 362/812; 362/159; 40/565

[58] Field of Search ..... 362/84, 147, 157, 362/159, 190, 191, 364, 365, 368, 376, 812, 145, 310, 347, 217; 40/545, 565, 568

[56] References Cited

U.S. PATENT DOCUMENTS

| | | | |
|---|---|---|---|
| 3,005,102 | 10/1961 | MacHutchin et al. | 362/84 |
| 3,233,096 | 2/1966 | Schmitt | 362/217 |
| 4,383,382 | 5/1983 | Hegarty | 40/545 |
| 4,907,361 | 3/1990 | Villard | 40/565 |

*Primary Examiner*—Stephen F. Husar
*Assistant Examiner*—Sara Sachie Raab
*Attorney, Agent, or Firm*—John Russell Uren

[57] ABSTRACT

A tamper-resistant fixture encloses a self-luminous radioactive light in order to prevent removal of the light. The fixture is secured to a mounting surface using tamper-resistant screws and anchors and allows the light to illuminate the immediate surroundings to mark an exit route without the necessity of power.

12 Claims, 3 Drawing Sheets

TAMPER-RESISTANT FIXTURE FOR SELF-LUMINOUS RADIOACTIVE LIGHT

This application is a continuation-in-part of U.S. patent application Ser. No. 08/069,378 filed Jun. 1, 1993, now abandoned.

INTRODUCTION

This invention relates to a lighting fixture and, more particularly, to a lighting fixture which restricts access to a self-luminous radioactive light source which is contained within the fixture. The light is used to mark an exit route for evacuation purposes under emergency egress or blackout conditions.

BACKGROUND OF THE INVENTION

The use of self-luminous radioactive lights for emergency purposes when external power is not available is known. One company, for example, Safety Light Corporation of Bloomsburg, Pennsylvania, manufactures exit and other emergency signs using such radioactive lights.

A self-luminous radioactive light is similar in some respects to conventional low pressure gas discharge fluorescent lights. A low pressure gas discharge light is created by coating the inside surface of a long glass tube with phosphors and injecting inert argon gas and a drop of mercury. An electrode is placed at each end and the tube is sealed. In operation, a current is applied to the electrodes so that the temperature of the electrode increases and so emits ions. A potential is applied between the two electrodes and the resulting electric field causes the emitted ions to drift through the tube. The ions strike and excite atoms of argon gas which in turn excite atoms of mercury. When the excited mercury atoms fall back to their unexcited valence state, photons are emitted which strike the inside surface of the tube and excite phosphors. The phosphors radiate light out of the glass tube.

In comparison, a self-luminous radioactive light is produced by coating the inside surface of a glass tube with phosphors and injecting a radioactive gas into the tube before the tube is sealed. As the radioactive gas decays, particles are emitted which strike and excite the phosphors on the inside of the glass tube. In turn, the phosphors radiate light out of the glass tube.

A preferred radioactive gas is tritium (a hydrogen isotope with two neutrons) which emits low energy beta radiation. Tritium decays to form helium.

Self-luminous radioactive lights according to the invention have been found to be particularly useful in emergency lighting applications where external power may be unavailable. Because they function independently of electricity and have lives typically as long as ten (10) to twenty (20) years, such lights are an inexpensive and dependable source of light in emergency situations. Self-luminous radioactive lights produce relatively small amounts of light and they are typically used as illumination for warning and directional signs.

Lights according to the invention are intended to be positioned at low heights along corridors to mark a pathway much in the way that reflectors are used to mark highway lanes at night. This installation technique is particularly useful because in the event of a power outage, the illumination from presently used battery powered incandescent bulbs can be obscured by smoke that may be moving in the pathway such as stairwells. Thus, the pathway may not be seen. In addition, of course, the life of the battery used to power such lights is quite limited. However, such installations can attract unwanted interest and vandalism. Because the light is part of an emergency system which must be continuously available and because it is manufactured with radioactive material, it is important to prevent the removal of such lights as far as possible.

SUMMARY OF THE INVENTION

According to the invention, there is provided a tamper-resistant fixture for a self-luminous radioactive light operable to he affixed to a surface, said fixture comprising a rearwardly located panel, an attachment for attaching said self-luminous radioactive light to said rearwardly located panel, a plurality of side panels attached to said rearwardly located panel about its perimeter, a forwardly located panel attached to said side panels operable to enclose said self-luminous radioactive light, and tamper-resistant means to attach said front panel to said surface.

BRIEF DESCRIPTION OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
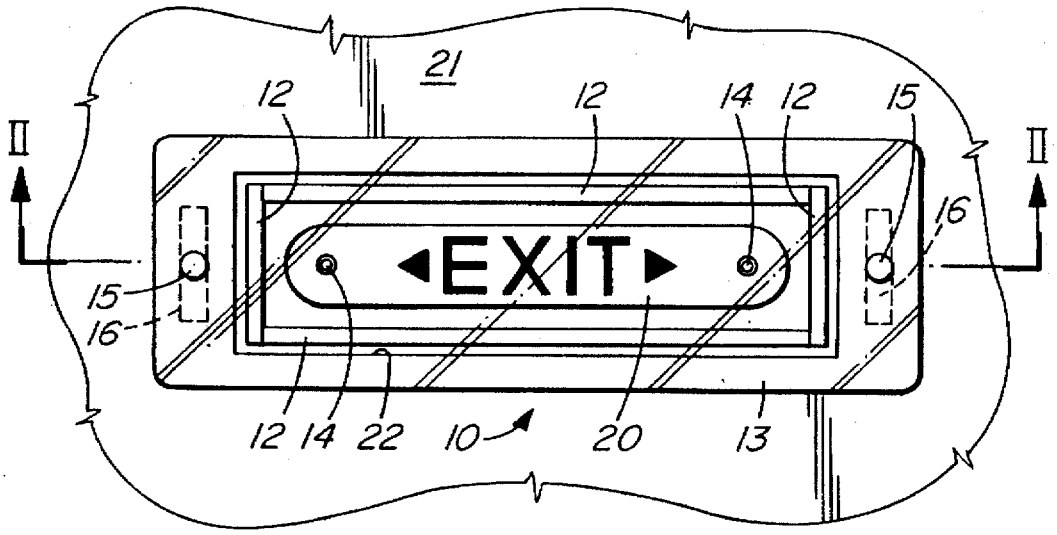
FIG. 1 is a diagrammatic front view of the fixture according to the invention in its flush-mount configuration.
Figure 2:
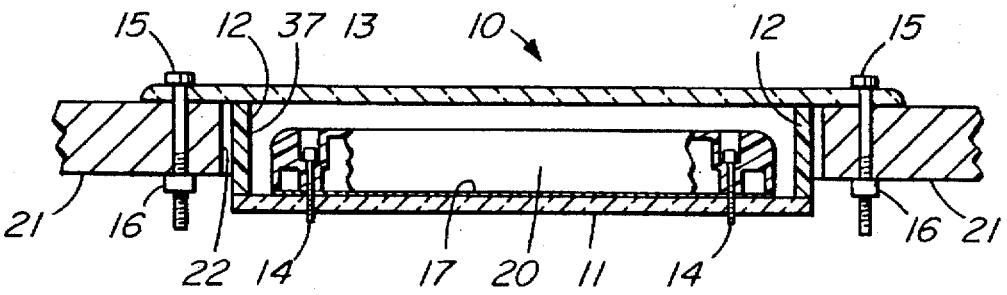
FIG. 2 is a diagrammatic sectional view of the apparatus of FIG. 1 taken along II—II of FIG. 1.

Referring now to the drawings, a tamper-resistant fixture for a self-luminous radioactive light according to the invention is generally illustrated at 10 in FIGS. 1 and 2. This flush-mount fixture 10 comprises a rear panel 11, a plurality of side panels 12 and a forwardly located front panel 13. A strip of transparent, high contact double face tape 17 is affixed to the inside surface of rear panel 11. Screws 14 extend through holes in a self-luminous radioactive light 20 and through rear panel 11. Tamper-resistant screws 15 extend through front panel 13. It is envisioned that the tamper-resistant aspect of screws 15 will include heads requiring non-standard screwdrivers. Anchors 16 are provided for securing the tamper-resistant screws 15.

A self-luminous radioactive light is illustrated at 20. The light 20 is mounted within the fixture 10 which is then mounted to a first surface 21. A longitudinal hole 22 is provided such that fixture 10 may be mounted flush with surface 21.

Figure 3:
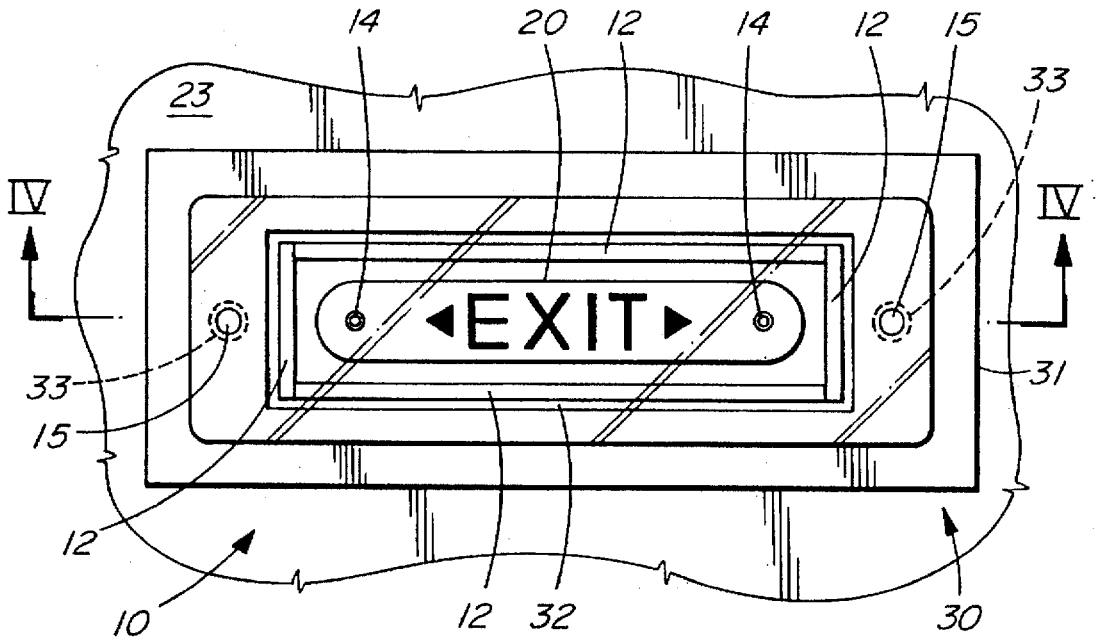
FIG. 3 is a diagrammatic front view of the fixture according to the invention in its surface-mount configuration.
Figure 4:
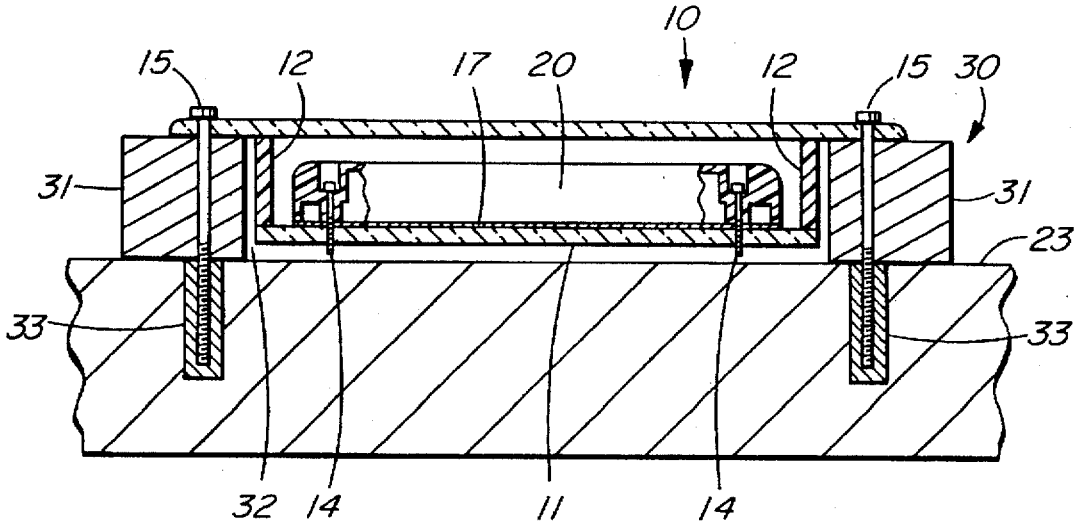
FIG. 4 is a diagrammatic sectional view of the apparatus of FIG. 3 taken along IV—IV of FIG. 3.

Referring to FIGS. 3 and 4, the surface-mount configuration of the invention is generally illustrated at 30. The surface-mount fixture 30 includes the flush-mount fixture 10 and a surface-mount adaptor 31 which includes a hole 35 therein. The surface-mount fixture 30 includes second anchors 37 in place of first anchors 16 as used with the flush-mount embodiment earlier described.

The fixture 30 is mounted to a second surface 23.

OPERATION

With reference to FIGS. 1 and 2, the self-luminous radioactive light 20 is initially positioned in the flush-mount fixture 10. The self-luminous radioactive light 20 is attached to the rear panel 11 using high contact double face clear tape strip 17 and mounting screws 14. Rear panel 11 is made of transparent plexiglass in order that the radioactive warning label and serial number on the back of radioactive light 20 may be seen. Side panels 12 are arranged around and attached to the perimeter of rear panel 11 such that a closed fixture in the form of a box is made. The side panels 12 and the rear panel 11 are chemically bonded together, conveniently by a solvent weld. Side panels 12 are made opaque and reflective to better direct and reflect light outward.

The front panel 13 is solvent welded to the side panels 12 so as to enclose the self-luminous radioactive light 20. Front panel 13 is made of a transparent high impact, high density polycarbonate material, an example of which is known as LEXAN (Trademark) to allow the light from the self-luminous radioactive light 20 to cast forward. It has been found that a 3/16 inch thickness for front panel 20 is of satisfactory strength.

Flush-mount fixture 10 is attached to first surface 21 by inserting the fixture 10 into hole 22, rear panel 11 first, until front panel 13 abuts the top of surface 21. Tamper-resistant screws 15 and first anchors 16 are used to secure the front panel 13 to the first surface 21 in a flush mounted or recessed manner.

With reference now to FIGS. 3 and 4, the surface-mount fixture 30 is attached to a second flat and continuous surface 23 by inserting the fixture 10, rear panel 11 first, into longitudinal hole 32 in surface-mount adaptor 31 which is, in turn placed flush against the second surface 23. Tamper-resistant screws 15 and second anchors 33 are then used to secure fixture 10 to the surface-mount adaptor 31 in a flush mounted or recessed manner and the surface-mount adaptor 31 to the second surface 23 in a surface mounted manner. At the end of the particular installation period, the fixture 10 is removed and a new fixture 10 is installed in the surface mount adaptor 31.

It may be convenient to place lettering 60 on the underside of the front panel 13 in order to specify the function of the light 20. For example, the words "<EXIT>", "FIRE HOSE", "EXTINGUISHER", "ALARM"/PULL" and the like could be used which would correspond with the particular function being served by the light 20.

It may also be convenient to have reflective or mirror surfaces 37 (FIG. 2) on the inside of side panels 12. This would enhance the light being emitted from the light 20 through front panel 13.

Figure 5A:
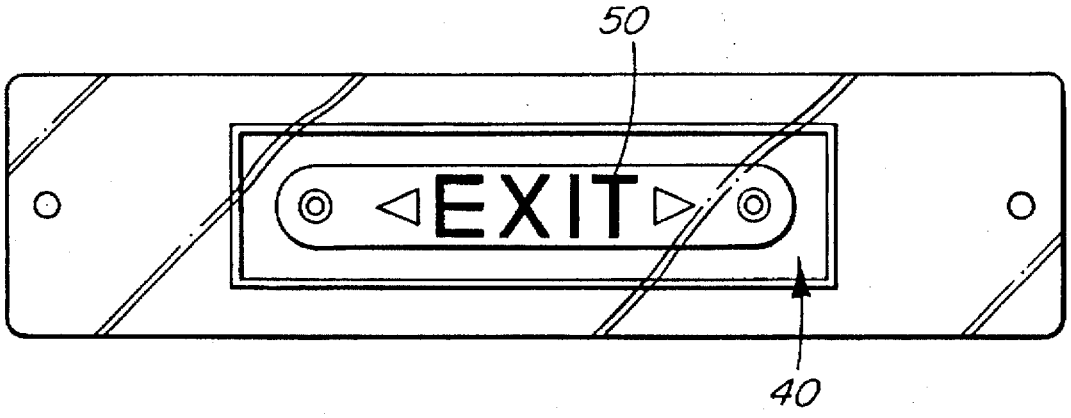
FIG. 5A is a plan view of a further embodiment of the invention.
Figure 5B:
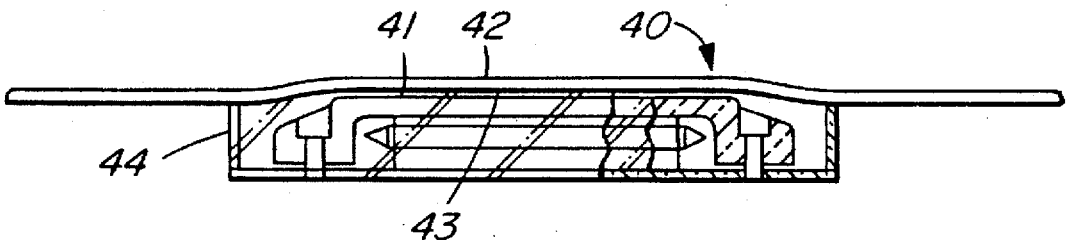
FIG. 5B is a front elevation of the embodiment of FIG. 5A.
Figure 5C:
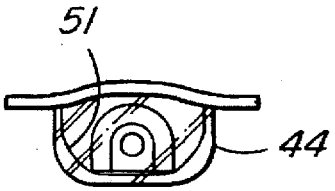
FIG. 5C is an end elevation view of the embodiment of FIG. 5A.

Yet a further embodiment of the invention is 10 illustrated in FIGS. 5A, 5B and 5C. In this embodiment, the faceplate generally illustrated at 40 covering the self-luminous radioactive light 41 has a highly polished lense 42 on the upper surface and a prismatic light refraction surface 43 on the underside, directly above the light source 41 which is enclosed by rear casing assembly 44.

The outside edge 50 of the faceplate is intended to fluorese to improve lateral visibility through incorporation of an integral light defraction dye into the polycarbonate material used to form the faceplate 40.

The casing 44 is molded from a clear, impact resistant polycarbonate with an integral V-O fire retardant chemical. It is preferably connected to the faceplate 40 by ultrasonic welding which facilitates installation of the unit from the front side of a wall in which the unit is to be installed.

The rear of the casing 44, as best seen in FIG. 5C, is mirrored on its internal surface 51 such that all light is reflected towards the faceplate 40 thereby to intensify the light visible through the faceplate 40.

Figure 6:
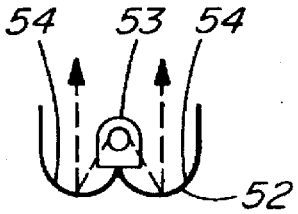
FIG. 6 is a view of yet a further embodiment of the invention.

Yet a further aspect of the invention is illustrated in FIG. 6. In this embodiment, the rear casing 52 is formed in a dual cusp shape with the light source 53 mounted centrally so as to straddle the dual cusps. A parabolic surface 54 is formed in each of the cusps and the mirrored surface reflects the light as illustrated so as to provide a more efficient light output and a visual brightening and broadening of the light. The light source 53 is intended to be mounted on self-tensioning polycarbonate guide pins (not illustrated) which will be integrally molded with the rear casing 52 and which will extend through holes (not illustrated) in the light source 53.

It is also intended to provide notches (not illustrated) on the rear casing 44. Such notches are intended to allow a metal casing to cover the entire rear casing 44. This would be appropriate and advisable, for example, when there is concern for fire separation and integrity of the unit under such conditions.

While a specific embodiment of the tamper-resistant fixture according to the invention has been described, many modifications will readily occur to those skilled in the art to which the invention relates and, accordingly, the description should be considered as illustrative of the invention only and not as limiting its scope as defined in accordance with the accompanying claims.

What is claimed is:

1. A tamper-resistant fixture for a self luminous radioactive light operable to be affixed to a surface, said fixture comprising a rearwardly located panel having a perimeter, an attachment for attaching said self-luminous radioactive light to said rearwardly located panel, a plurality of side panels attached to said rearwardly located panel about said perimeter and extending towards a forwardly located panel, said forwardly located panel being permanently attached to said side panels and extending beyond the perimeter of said side panels for attachment to said surface, said forward panel being operable to permanently enclose said self-luminous radioactive light, and tamper-resistant means to attach said forwardly located panel to said surface.

2. A fixture as in claim 1 wherein said forwardly located panel is transparent.

3. A fixture as in claim 2 wherein said forwardly located panel is impact-resistant.

4. A fixture as in claim 2 wherein said rearwardly located panel is transparent.

5. A fixture as in claim 2 wherein the inside surfaces of said side panels are reflective.

6. A fixture as in claim 2 wherein said tamper-resistant means are tamper-resistant screws and anchors.

7. A fixture as in claim 1 wherein said forwardly located panel further includes instructional words.

8. A fixture as in claim 7 wherein at least one of said plurality of said side panels is a reflective surface.

9. A fixture as in claim 1 wherein said rearwardly located panel is formed as a mirrored cusp shaped surface, said self-luminous radioactive light being mounted so as to reflect light off said cusp shaped surface and through said forwardly facing panel.

10. A fixture as in claim 9 wherein said rearwardly located panel is formed as a mirrored dual cusp shaped surface, said self luminous radioactive light being mounted centrally so as to reflect light off each cusp shaped surface.

11. A fixture as in claim 10 wherein said rearwardly located panel and said plurality of side panels form a casing, said casing being welded to said forwardly located panel.

12. A fixture as in claim 11 wherein said casing includes integrally molded guide pins operable to fit complementary holes in said self-luminous radioactive light, said light being mounted on said guide pins.

* * * * *